US011373833B1

(12) United States Patent
Hoff et al.

(10) Patent No.: US 11,373,833 B1
(45) Date of Patent: Jun. 28, 2022

(54) SYSTEMS, METHODS AND APPARATUS FOR FABRICATING AND UTILIZING A CATHODE

(71) Applicant: Government of the United States of America as represented by the Secretary of the Air Force, Kirtland AFB, NM (US)

(72) Inventors: Brad Winston Hoff, Albuquerque, NM (US); Wilkin Wai-Hang Tang, Albuquerque, NM (US); Sterling Ryan Beeson, Tijeras, NM (US); Ali Sayir, Bay Village, OH (US)

(73) Assignee: Government of the United States, as Represented by the Secretary of the Air Force, Kirtland AFB, NM (US)

( * ) Notice: Subject to any disclaimer, the term of this patent is extended or adjusted under 35 U.S.C. 154(b) by 0 days.

(21) Appl. No.: 16/591,030

(22) Filed: Oct. 2, 2019

Related U.S. Application Data

(60) Provisional application No. 62/741,892, filed on Oct. 5, 2018.

(51) Int. Cl.

| | |
|---|---|
| ***H01J 1/62*** | (2006.01) |
| ***H01J 9/00*** | (2006.01) |
| ***H01J 9/02*** | (2006.01) |
| ***H01J 1/304*** | (2006.01) |

(52) U.S. Cl.
CPC ..... *H01J 9/025* (2013.01); *H01J 1/304* (2013.01)

(58) Field of Classification Search
CPC ..... H01J 9/025; H01J 1/304
See application file for complete search history.

(56) References Cited

U.S. PATENT DOCUMENTS

| | | | | |
|---|---|---|---|---|
| 3,497,332 | A | 2/1970 | Donnelly et al. | |
| 3,503,001 | A | 3/1970 | Farney | |
| 5,648,180 | A * | 7/1997 | Lauf | B23K 35/007 228/124.1 |
| 5,904,287 | A | 5/1999 | Tashiro et al. | |
| 6,047,876 | A | 4/2000 | Smith | |
| 6,367,683 | B1 | 4/2002 | Rass et al. | |
| 6,554,179 | B2 | 4/2003 | Horner et al. | |
| 6,683,399 | B2 | 1/2004 | Shiftier, Jr. | |
| 6,856,080 | B2 | 2/2005 | Shiftier, Jr. et al. | |
| 6,877,651 | B2 | 4/2005 | Sandin | |
| 7,132,161 | B2 * | 11/2006 | Knowles | C09J 7/00 428/364 |
| 7,169,437 | B1 | 1/2007 | Shiftier, Jr. et al. | |
| 7,666,051 | B2 * | 2/2010 | Ren | H01J 1/304 445/49 |

(Continued)

OTHER PUBLICATIONS

Hoff et al., Brazed carbon fiber field emission cathode, Rev. Sci. instrum, 91,064702,2020 (Year: 2020).*

(Continued)

*Primary Examiner* — Tracie Y Green
(74) *Attorney, Agent, or Firm* — AFNWC/JA; David L. Narciso

(57) ABSTRACT

Systems, methods and apparatus related to a method for constructing a field emission device. The method includes providing a metal cathode substrate; shaping a carbon fiber fabric into a pattern, creating a patterned carbon fiber fabric; and brazing at least a portion of the patterned carbon fiber fabric to the metal cathode substrate.

12 Claims, 14 Drawing Sheets

(56) References Cited

U.S. PATENT DOCUMENTS

| | | | | |
|---|---|---|---|---|
| 8,193,692 | B2 * | 6/2012 | Lee | H01J 1/304 313/495 |
| 8,541,335 | B2 | 9/2013 | Shugart et al. | |
| 8,593,049 | B2 | 11/2013 | Son et al. | |
| 8,710,727 | B2 | 4/2014 | Liu et al. | |
| 8,766,522 | B1 | 7/2014 | Fairchild et al. | |
| 8,841,830 | B2 | 9/2014 | Liu et al. | |
| 8,841,867 | B2 | 9/2014 | Gilgenbach et al. | |
| 2003/0010809 | A1 | 1/2003 | Lewandowski et al. | |
| 2003/0100239 | A1 * | 5/2003 | Gaffney | C04B 35/83 442/354 |
| 2005/0228157 | A1 | 10/2005 | Peterson et al. | |
| 2005/0248250 | A1 * | 11/2005 | Korenev | H01J 9/025 313/311 |
| 2009/0167140 | A1 | 7/2009 | Hu | |
| 2010/0181896 | A1 | 7/2010 | Lee et al. | |
| 2011/0027537 | A1 * | 2/2011 | Inoue | H01G 11/26 428/172 |
| 2013/0134860 | A1 | 5/2013 | Kim et al. | |

OTHER PUBLICATIONS

Liu_et_al_Brazing_CSiC_Composites_and_NB_with_TINiNb_active_guller_material_02-2011_.pdf (Year: 2011).*

Yuxiang et al. Special brazing and soldering , (Year: 2020).*

Weld-bonded_stainless_steel_to_carbon_fibre-reinforced_plastic_joints_Elsevier_Enhanced_Reader.pdf (Year: 2018).*

D. Shiftier et al., "Comparison of velvet- and cesium iodide-coated carbon fiber cathodes," in IEEE Transactions on Plasma Science, vol. 29, No. 3, pp. 445-451, Jun. 2001.

D. Shiffler et al., "Demonstration of an Acid-Spun Single-Walled Nanotube Fiber Cathode," in IEEE Transactions on Plasma Science, vol. 40, No. 7, pp. 1871-1877, Jul. 2012.

D. Shiffler et al., "Investigation of RF breakdowns on the MILO," in IEEE Transactions on Plasma Science, vol. 26, No. 3, pp. 304-311, Jun. 1998.

D. Shiffler, M. Ruebush, M. Haworth, and R. Umstattd, "Carbon velvet field-emission cathode," Review of Scientific Instruments 73, 4358 (2002).

Deng, Chaoyong & Zhang, Hongbo & Yin, Jian & Xiong, Xiang & Wang, Pei & Sun, Miao. (2017). Carbon fiber/copper mesh reinforced carbon composite for sliding contact material Materials Research Express. 4.

E. Romero et al., "Characterization and optimization of a flash X-ray source for dense spray radiography," 2008 IEEE 35th International Conference on Plasma Science, Karlsruhe, 2008, pp. 1-1.

Fowler Ralph Howard and Nordheim L., "Electron emission in intense electric fields," Proc. R. Soc. A Math. Phys. Eng. Sci. 119, 173-181, http://doi.org/10.1098/rspa.1928.0091, 1928.

Gilgenbach, R.M. & Lau, Yue-Ying & French, D. & Hoff, Brad & Franzi, Matthew & Luginsland, John. (2011). Recirculating Planar Magnetrons for High-Power High-Frequency Radiation Generation. Plasma Science, IEEE Transactions on. 39. 980-987.

J. Haystead, "The Domain of the Tube—Millimeter Wave and Beyond"—Journal of Electronic Defense, Mar. 2018, pp. 24-31.

J. M. Parson, C. F. Lynn, J. J. Mankowski, A. A. Neuber and J. C. Dickens, "Emission Behavior of Three Conditioned Carbon Fiber Cathode Types in UHV-Sealed Tubes at 200 A/$\mathrm{cm}^{2}$," in IEEE Transactions on Plasma Science, vol. 42, No. 12, pp. 3982-3988, Dec. 2014.

Liu, Lie & Li, Limin & Wen, Jianchun & Wan, Hong. (2009). Robust, easily shaped, and epoxy-free carbon-fiber-aluminum cathodes for generating high-current electron beams. The Review of scientific instruments. 80.

S. C. Exelby et al., "Design and development of the recirculating crossed-field amplifier," 2017 Eighteenth International Vacuum Electronics Conference (IVEC), London, 2017, pp. 1-2.

S-bond Technologies, "Joining Graphite and Carbon to Metals," https://www.s-bond.com/blog/2011/05/16/graphite-carbon-joined-to-metals-with-s-bond%C2%AE/ , May 16, 2011.

Shiftier, D.; Heggemeier, J.; LaCour, M.; Golby, K.; Ruebush, M., "Low level plasma formation in a carbon velvet cesium iodide coated cathode," Physics of Plasmas, vol. 11, Issue 4, pp. 1680-1684 (2004).

T. P. Fleming and P. J. Mardahl, "Performance Improvements in the Relativistic Magnetron: The Effect of DC Field Perturbations," in IEEE Transactions on Plasma Science, vol. 37, No. 11, pp. 2128-2138, Nov. 2009.

Tang, Wei & Golby, Ken & LaCour, Matthew & Knowles, Timothy. (2014). Experimental Study of Electric Field Screening of Four Carbon Fiber Cathodes in a Linear Array Configuration. Plasma Science, IEEE Transactions on.

Tang, Wilkin & Shiftier, Don & Golby, Ken & LaCour, Matthew & Knowles, Tim. (2014). Field enhancement for fiber emitters in linear and rectangular arrays. Journal of vacuum science & technology. B, Microelectronics and nanometer structures: processing, measurement, and phenomena: an official journal of the American Vacuum Society.

Timothy R. Knowles, "carbon Velvet Cathodes," NRL Cathodes Workshop, May 10, 2001.

Wang, Ding & Song, Pengcheng & Liu, Changhong & Wu, Wei & Fan, Shoushan. (2008). Highly oriented carbon nanotube papers made of aligned carbon nanotubes. Nanotechnology. 19.

Y. M. Saveliev, S. N. Spark, B. A. Kerr, M. I. Harbour, S. C. Douglas and W. Sibbett, "Effect of cathode end caps and a cathode emissive surface on relativistic magnetron operation," in IEEE Transactions on Plasma Science, vol. 28, No. 3, pp. 478-484, Jun. 2000.

Y. Sekii and T. Hayashi, "Measurements of Reflectance and Thermal Emissivity of a Black Surface Created by Electrostatic Flocking with Carbon-Fiber Piles," in IEEE Transactions on Dielectrics and Electrical Insulation, vol. 16, No. 3, pp. 649-654, Jun. 2009.

Yamada, Yasuhiro & Chung, Deborah. (2008). Epoxy-based carbon films with high electrical conductivity attached to an alumina substrate. Carbon. 46. 1798-1801.

Yongdong Xu,, Litong Zhang, Laifei Cheng, Dantao Yan, "Microstructure and mechanical properties of three-dimensional carbon/silicon carbide composites fabricated by chemical vapor infiltration," Carbon, vol. 36, Issues 7-8, 1998, pp. 1051-1056.

Zhang, K.X. & Zhao, W.K. & Zhang, F.Q. & He, L.L.. (2017). New wetting mechanism induced by the effect of Ag on the interaction between resin carbon and AgCuTi brazing alloy. Materials Science and Engineering: A. 696.

* cited by examiner

100

200

SYSTEMS, METHODS AND APPARATUS FOR FABRICATING AND UTILIZING A CATHODE

STATEMENT OF GOVERNMENT INTEREST

The embodiments described herein may be manufactured and used by or for the Government of the United States for all governmental purposes without the payment of any royalty.

FIELD OF THE DISCLOSURE

The present disclosure relates to fabricating and utilizing a cathode, such as a field effect cathode.

BACKGROUND

While field emission cathodes using carbon-to-carbon or carbon-to-epoxy bonding are presently considered to be state of the art, these cathodes have a number of drawbacks. Vacuum electron tubes require good vacuums to operate effectively. Bulk carbon and graphite, when used as cathode substrates can be difficult to de-gas and can represent a loss mechanism for electromagnetic oscillations generated in the tube due to their higher resistivity, compared to metals.

BRIEF SUMMARY

Embodiments described herein are directed to systems, methods and apparatus for fabricating and utilizing a cathode, such as field emission cathode.

One embodiment is directed to a method for constructing a field emission device. This method includes providing a metal cathode substrate. A carbon fiber fabric is shaped into a pattern, creating a patterned carbon fiber fabric. At least a portion of the patterned carbon fiber fabric is brazed to the metal cathode substrate.

BRIEF DESCRIPTION OF THE DRAWINGS

The accompanying drawings, which are incorporated in and constitute a part of this specification, illustrate embodiments of the present disclosure and, together with a general description given above, and the detailed description given below, serve to explain the principles of the present disclosure.

Figure 1:
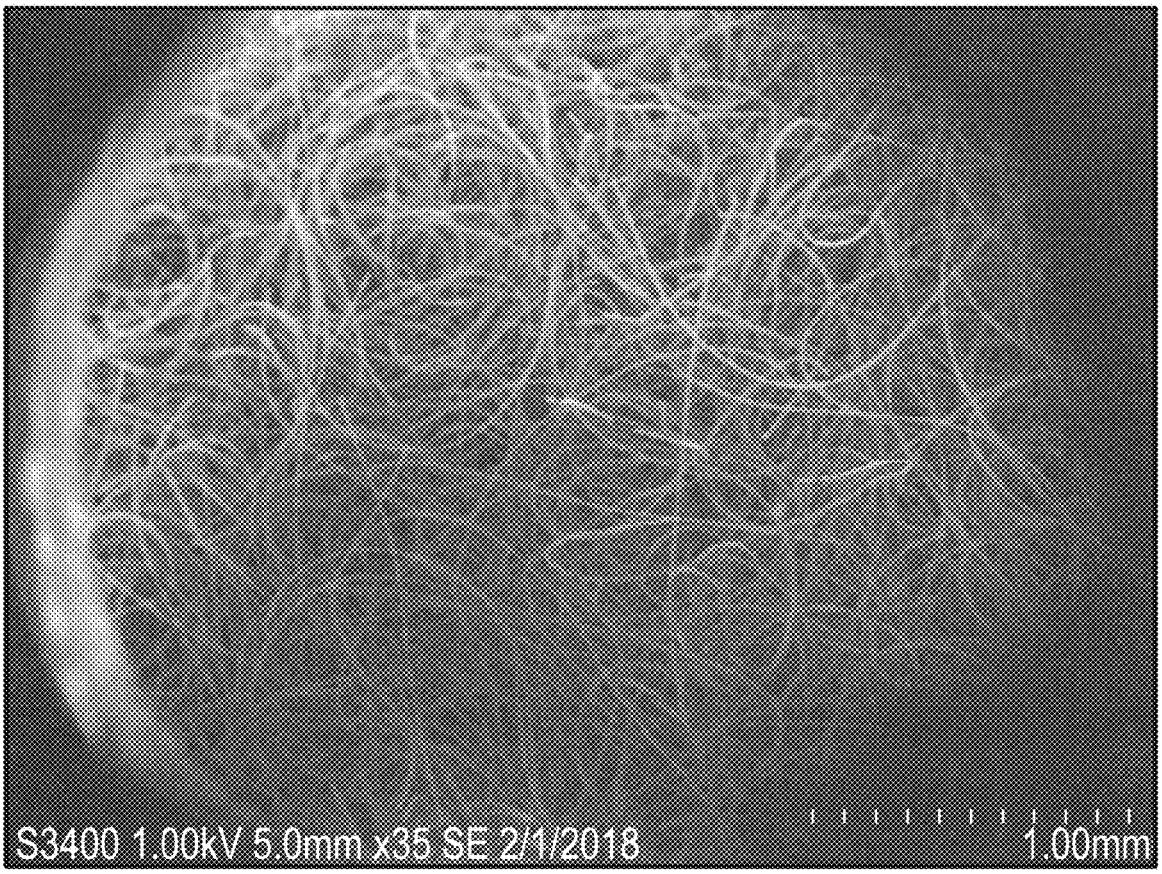
FIG. 1 shows a scanning electron microscope image of a surface region of a selected carbon fiber fabric.

It should be understood that the appended drawings are not necessarily to scale, presenting a somewhat simplified representation of various features illustrative of the basic principles of the disclosure. The specific design features of the sequence of operations as disclosed herein, including, for example, specific dimensions, orientations, locations, and shapes of various illustrated components, will be determined in part by the particular intended application and use environment. Certain features of the illustrated embodiments have been enlarged or distorted relative to others to facilitate visualization and clear understanding. In particular, thin features may be thickened, for example, for clarity or illustration.

DETAILED DESCRIPTION

The present disclosure will now be described more fully hereinafter with reference to the accompanying drawings, in which preferred embodiments are shown. This disclosure may, however, be embodied in many different forms and should not be construed as limited to the embodiments set forth herein. Rather, these embodiments are provided so that this disclosure will be thorough and complete, and will fully convey the scope to those skilled in the art.

For applications requiring high current, high voltage electron beams, and long lifetime such as vacuum electron tubes and accelerators, field emission cathodes (sometimes called "cold cathodes") are typically used as the electron beam emitter. During the field emission process, the electric field is strong enough that electrons quantum mechanically tunnel through the potential barrier created at the surface of the cathode material by the process known as Fowler-Nordheim tunneling.

Field emission properties of a cathode are dependent upon the strength of the applied electric field as well as the work function of the material and electron transport properties within the material. For vacuum electron devices, field emission cathodes based on carbon fiber emitters have emerged as a leading technology for generating high voltage, high current electron beams. The reasons carbon fiber is the material of choice include its large surface area per unit volume, mechanical strength and flexibility, and good resistance to erosion during electron emission in vacuum, and operability over a wide range of temperature regimes.

In addition, carbon fiber field emission cathodes have been shown to operate into the space charge limited regime, as desired for many vacuum electron tubes and devices. These cathodes can also achieve low gassing operation for long operational life time at current densities reaching 100 s of $A/cm^2$.

When making larger area cathodes with conventional "carbon-to-epoxy" or "carbon-to-carbon" methods, a substrate material is typically coated with a thin layer, typically less than approximately 0.5 mm thick of adhesive or epoxy.

Carbon fibers are then partially embedded in the adhesive layer using an electrostatic flocking process, forming a random or semi-random array or "forest" of carbon fibers that are bonded to the substrate surface. When the substrate material is a metal, a conductive epoxy is typically used, to ensure electrical conductivity between the substrate and the fibers (this may be referred to as the "carbon-to-epoxy" method).

When the substrate material is bulk carbon, graphite, or some ceramic material, a carbon bond may be formed by using an adhesive resin that can be chemically converted to a carbon or mostly-carbon film by processing at high temperature (this may be referred to as the "carbon-to-carbon" method).

While metal substrates have desired vacuum properties and are less lossy to microwaves, the epoxy layer, being much more resistive than the underlying metal substrate, reduces the efficiency of electron transfer from the substrate to the carbon fibers, thus reducing the overall performance of the cathode. Additionally, the epoxy itself may outgas, may have limited temperature operability, and, thus, may reduce the quality of the vacuum in the vacuum electron tube or accelerator.

The present disclosure describes an improvement to the state of the art that reduces the aforementioned drawbacks of carbon fiber field emission cathodes using carbon-to-carbon or carbon-to-epoxy bonds between the fibers and the cathode substrate by providing a field emission cathode with a carbon-to-metal bond layer between the carbon fibers and a metal substrate. This disclosure also provides an improved electron beam generating device, such as a microwave tube, with a field emission cathode having a carbon-to-metal bond between the carbon fibers and a metal substrate.

As described herein, this disclosure provides an apparatus and a method to provide field emission cathodes having a carbon fabric emission layer bonded to a metal substrate.

Since fabrication of field emission cathodes having a forest of individual carbon fiber emitters often incurs additional complications associated with the desire for electrostatic flocking, an improved cathode fabrication method is provided that utilizes a layer of carbon fiber fabric bonded to metal.

This fabric may consist of carbon fibers woven into a cloth or may consist of a layer or layers of tangled carbon fibers pressed together into a flexible felt.

FIG. 1 shows a scanning electron microscope image 100 of a surface region of a selected carbon fiber fabric.

Figure 2:
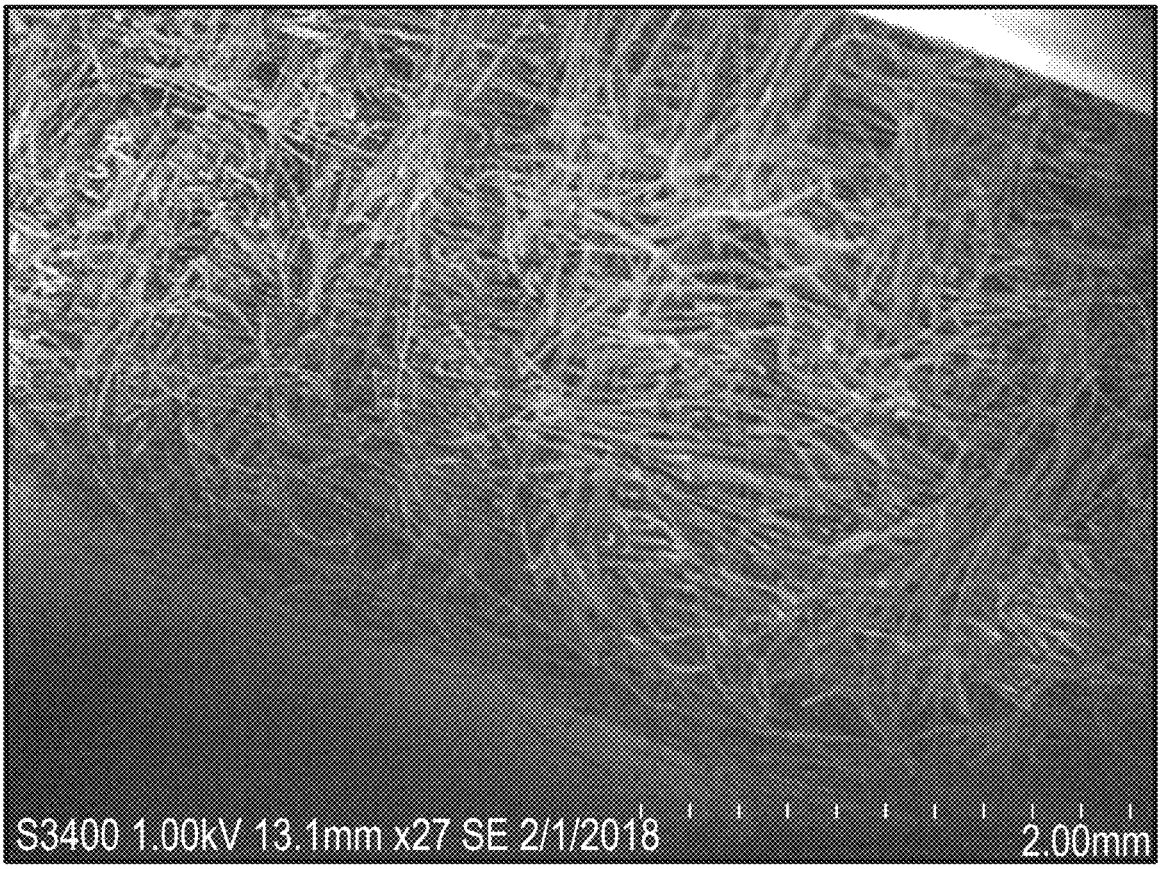
FIG. 2 shows a scanning electron microscope image of another surface region of a selected carbon fiber fabric.

FIG. 2 shows a scanning electron microscope image 200 of another surface region of a selected carbon fiber fabric.

As shown in the scanning electron microscope images provided in FIG. 1 and FIG. 2, the flexibility of the fabric allows for its use for a wide variety of cathode geometries (flat, spherical, cylindrical, bumpy, etc.), which is typically a design choice and may be used with any suitable geometry to which the fabric can be shaped.

Figure 3:
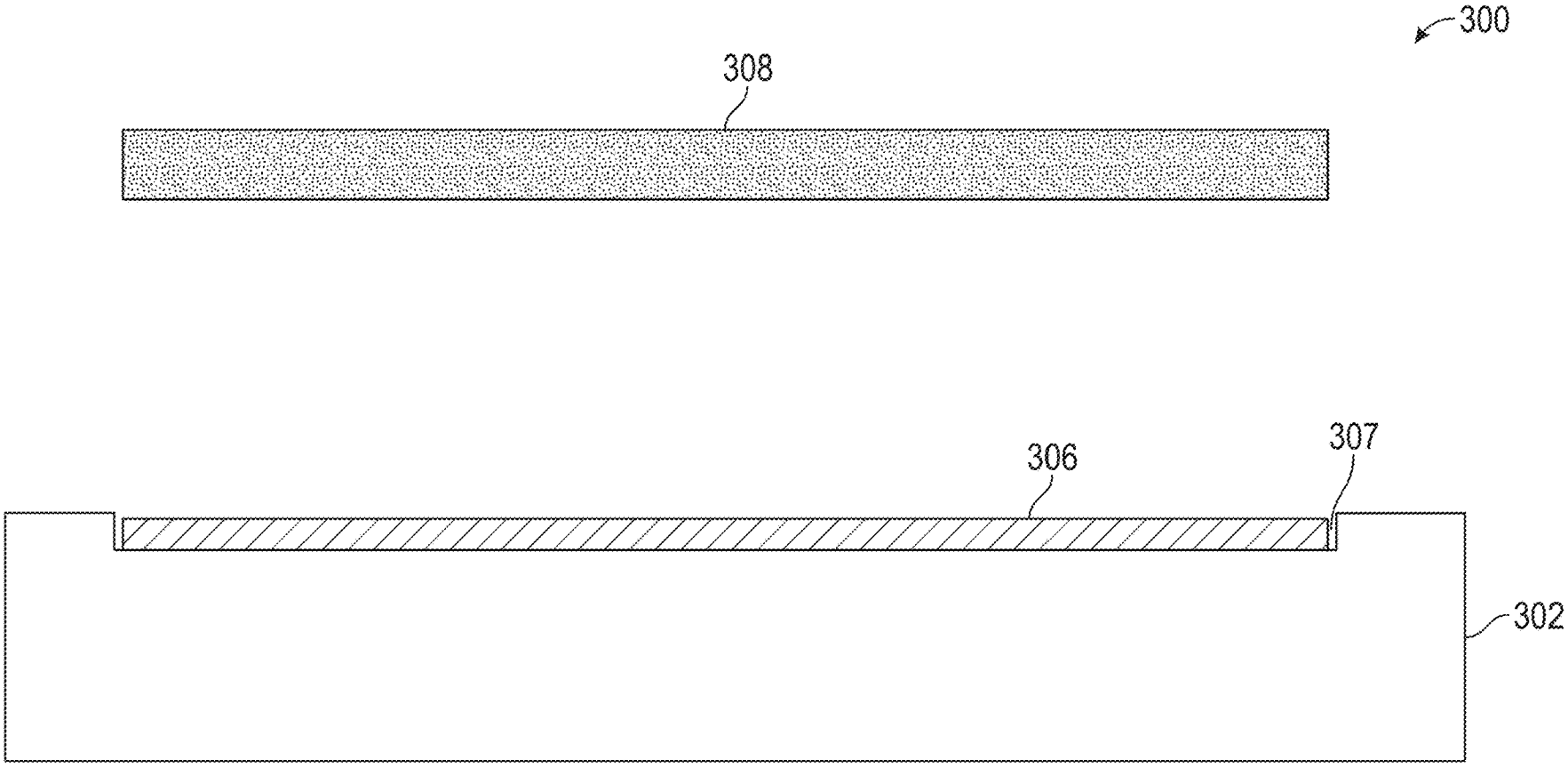
FIG. 3 shows a representation of unassembled components of an exemplary field emission cathode having a carbon fabric emission layer.

FIG. 3 shows a representation 300 of unassembled components of an exemplary field emission cathode having a carbon fabric emission layer. As shown in FIG. 3, there is a metal substrate 302, indentation, or basin, 307, braze alloy 306 and carbon fiber fabric 308. The carbon fabric 308 is a carbon fabric emission layer.

Figure 4:
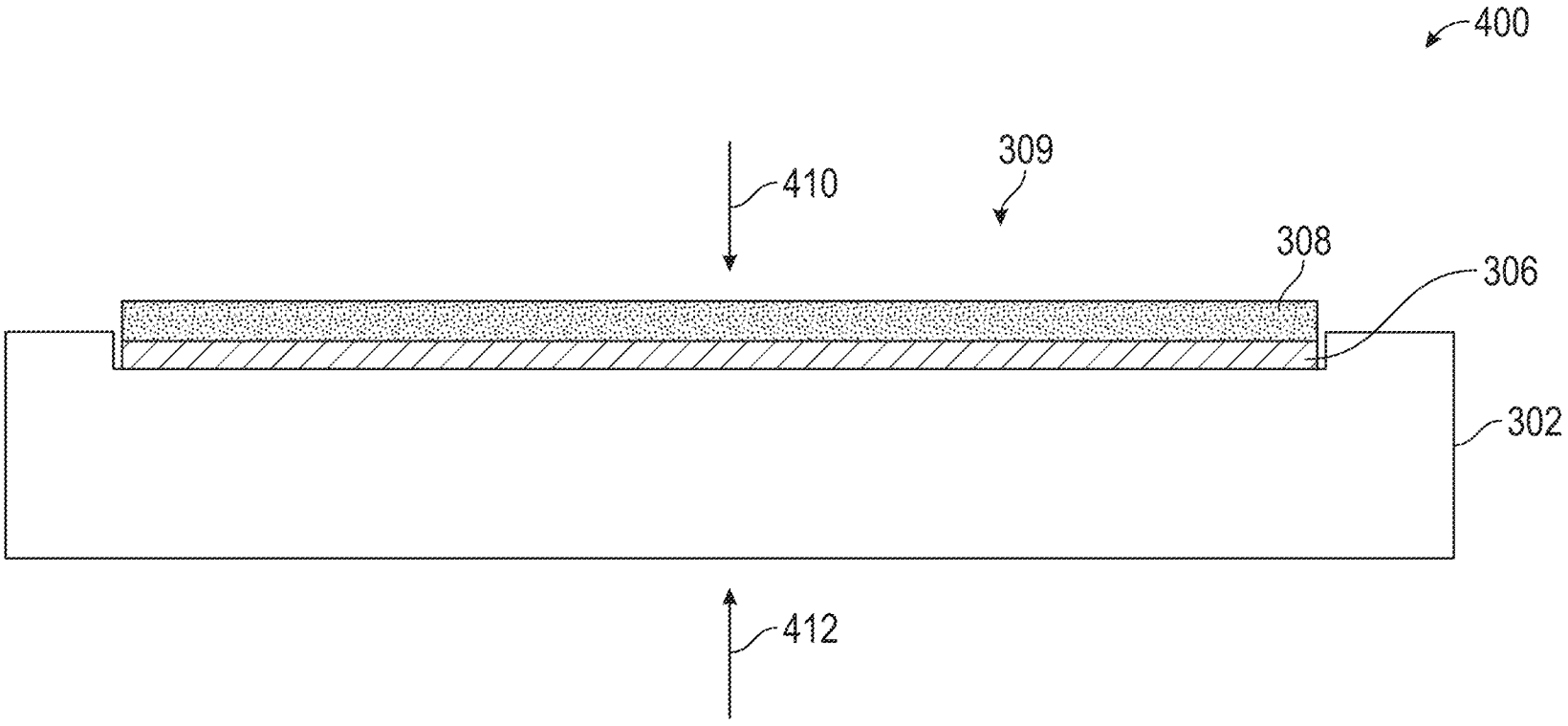
FIG. 4 shows an illustration of an assembly and brazing of an exemplary field emission cathode having a carbon fabric emission layer.

FIG. 4 shows an illustration 400 of a carbon fabric cathode 309 that includes the metal substrate 302, braze alloy 306 and carbon fabric 308 (carbon fabric 308 is typically a carbon fabric emission layer). Forces 410 and 412 are shown.

Figure 5:
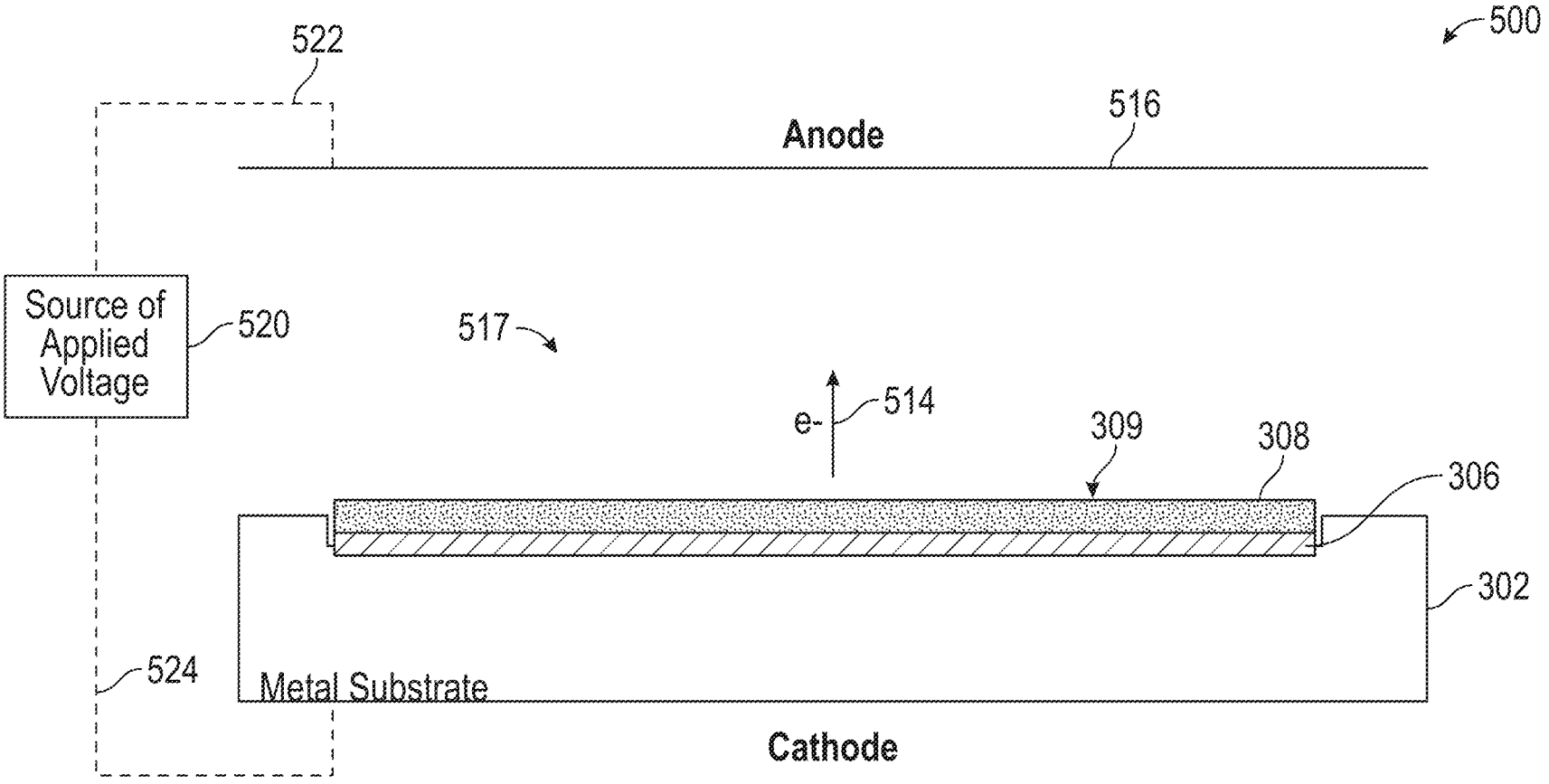
FIG. 5 shows an illustration of an electron beam emission from a brazed carbon fabric cathode.

FIG. 5 shows an illustration 500 of an electron beam emission from a brazed carbon fabric cathode 309. As shown, the carbon fabric cathode 309 includes metal substrate 302, braze alloy 306 and carbon fabric 308. Anode 516 is shown as is source of applied voltage 520 with anode path 522 and cathode path 524. The carbon fabric cathode 309 emits electrons from the carbon fabric 308 into the vacuum region 517 through which they travel toward the anode 516, as shown by 514.

A process(es) describing fabrication of field emission cathodes having a carbon fabric emission layer bonded to a metal substrate and field emission of an electron beam from the fabric layer are detailed as follows, and described by referring to FIGS. 3-5. As the description references FIGS. 3-5, reference numerals are provided in parenthesis that correspond to one or more of elements in FIGS. 3-5.

1. A suitable carbon fiber fabric (308) is identified. The fabric (308) should have good electron field emission properties and should be compatible with the bonding process used to attach the carbon fiber fabric (308) to the metallic substrate (302). In some cases, the fabric (308) may be pre-treated using various thermal, chemical, and/or mechanical processes to enhance field emission properties or compatibility with the bonding process.

2. A metal cathode substrate (302) is fabricated using an appropriate machining, casting, 3D printing, or other forming process. The substrate (302) should have good vacuum properties and have material and surface properties compatible with the bonding process. Typically, several metals and alloys including, but not limited to, metals like copper and stainless steel will work acceptably with a bonding process such as brazing, sometimes called "active brazing" when referring to brazing alloys that bond carbon to metal. In cases where only a portion of the cathode substrate (302) is to be covered, a small indentation (307) may be machined to enable positioning of the fabric (308); however, this indentation (307) is optional.

3. The carbon fiber fabric (308) is then cut into a desired pattern to cover the desired area of the cathode substrate (302). Once the carbon fiber has been cut, it can be considered a patterned carbon fiber fabric (308). Preferentially, the cathode fabric (308) is cut with a laser cutting tool to enable high precision; however, the fabric (308) may also be cut with mechanical or other appropriate techniques.

4. The brazing alloy or metallic compound (306) to be used to form the carbon to metal bond between the substrate (302) and the carbon fiber fabric (308), is positioned between the patterned carbon fiber fabric (308) and the substrate (302).

In the case depicted in FIG. 3, a shallow basin, or indentation, (307) with an area slightly greater than that of the fabric area is machined in the substrate (302). A brazing alloy layer (306) is then applied to the surfaces of the basin (307) to be joined to the patterned carbon fiber fabric (308). It is noted that because there are a variety of different brazing alloys (306) that can be used for bonding carbon to metal, the brazing alloy (306) may take the form of pastes, sheets, powders, or other formats. In some cases, some braze alloy formulations may be enhanced by specific surface preparation procedures, which may be selected according to applicable procedures for each alloy. It is further noted that the basin (307) is implemented for convenience and is optional for positioning the braze alloy (306) and the patterned carbon fiber fabric (308).

5. In order to fuse the patterned carbon fiber fabric (308) to the metal substrate (302), the patterned carbon fiber fabric (308), braze alloy (306), and metal substrate (302) are compressed together as shown in FIG. 4 (410, 412) and then the carbon fabric cathode (309) is heated in a furnace to liquify the braze alloy (306) and enable it to wet the surfaces of the metal substrate and the fabric layer that are to be bonded. Depending on the chosen braze alloy formulation, the wetting process on the surface ofthe carbon may involve the formation of a thin, tightly adhering layer, or layered polyphase structure of chemical reaction products on the surface of the individual carbon fibers resulting from interaction of the carbon and certain metallic elements, alloys and/or compounds and mixtures ofthese constituent phases within the braze alloy when heated to high temperatures such as approximately 700 degrees Celsius. This layer or layered polyphase structure is then is what is actually wet by the remainder of the braze alloy (306).

This reaction product layer is either highly electrically conductive or represents a low enough tunneling gap for electrons to readily move from the metal substrate (302) through the braze alloy (306) and reaction product layer into the carbon fiber (308) under the influence of a suitable applied electric field. It is noted that as part of this step, parameters such as a controlled atmosphere within the furnace (inert gas or vacuum), heating and cooling rates, and temperature limits will vary according to the characteristics of the specific braze alloy (306) formation chosen. During heating, the force (410, 412) compressing the fabric layer onto the surface of the metal substrate may be provided by some combination of gravity, centripetal force, centrifugal force, or mechanical force applied by tooling or mechanical assemblies of an appropriate nature.

For complicated cathode surface geometries (spherical, cylindrical, or arbitrary), some amount of mechanical tooling will likely be used to ensure proper compression over the required cathode area. Following successful completion of this step, the carbon fabric cathode (309) is cooled back to room temperature at a rate that is appropriate to maintain the integrity of the braze alloy bond and the substrate (302).

6. The bonded carbon fabric cathode (309) is installed into an electron beam generating device such that the patterned carbon fiber fabric (308) emission surface and volume within the electron beam generating device in which the beam is intended to propagate is at vacuum. A source of applied voltage (520) is connected between the carbon fabric cathode (309) and the surfaces of electron beam generating device that serve as the anode (516). The applied voltage (520) may be continuous, pulsed, or some arbitrary time-changing waveform. During periods of time in which electron emission (514) from the cathode (309) is desired the applied voltage waveform must be such that the carbon fabric cathode (309) is at a negative voltage with respect to the anode (516).

Additionally, during periods of time in which electron emission (514) from the carbon fabric cathode (309) is desired the voltage between the carbon fabric cathode (309) and the anode (516) will be of sufficient magnitude that electrons will tunnel from the carbon fibers comprising the patterned carbon fiber fabric (308) into the vacuum gap, according to the field emission process, where they will be accelerated toward the anode (516). A continuous, pulsed, or time-changing magnetic field may also be present in the region of the carbon fabric cathode (309) and beam propagation regions of the electron beam generating device as required for proper motion of the electron beam (514) within the device.

Advantages of an electron beam generating device or vacuum electron tube incorporating the present invention include, but are not limited to, the following:

1. Brazed carbon fabric cathodes (309) do not utilize epoxy as compared to carbon fiber field emission cathodes using carbon-to-epoxy bonds, and thus permit the vacuum electron tube into which they are integrated to be baked up to high temperature of approximately 200 degrees Celsius (as long as this temperature is below the brazing or joining temperature of the carbon-to-metal bond) to enable better degassing of the tube and thus enable a better quality vacuum to exist within the tube. Baking temperatures are informed by the melting temperature of the braze alloy or other parameters of structures in the tube.

2. Field emission cathodes with a carbon-to-metalbond, such as brazed carbon fabric cathodes, do not rely on bulk carbon or graphite substrates as do carbon fiber field emission cathodes using carbon-to-carbon bonds to the substrate; therefore, they are less lossy compared to oscillatory electromagnetic fields within the vacuum electron tube, which may enable higher efficiency operation of the tube.

3. Brazed carbon fabric field emission cathodes are less complex to fabricate due to the lack of need for electrostatic flocking of fibers. This makes the overall vacuum electron tube less complicated and typically less expensive to fabricate.

4. Unlike other cathodes, fabrication of the disclosed cathodes does not require use of a crucible or a high-pressure liquid metal injection assembly, which allows for easier, less expensive fabrication of cathodes. Additionally, the brazed carbon fabric cathodes (309) are easier to fabricate in configurations that have a wide variety of geometries, such as radial or cylindrical emission configurations, than would be the carbon fiber aluminum cathodes.

5. Carbon-to-metal field emission cathodes, having a fabric comprised of carbon fibers (308), are compatible with carbon fiber cathode emission enhancement techniques such as the application of cesium iodide to carbon fibers.

ADDITIONAL EMBODIMENTS

Figure 6:
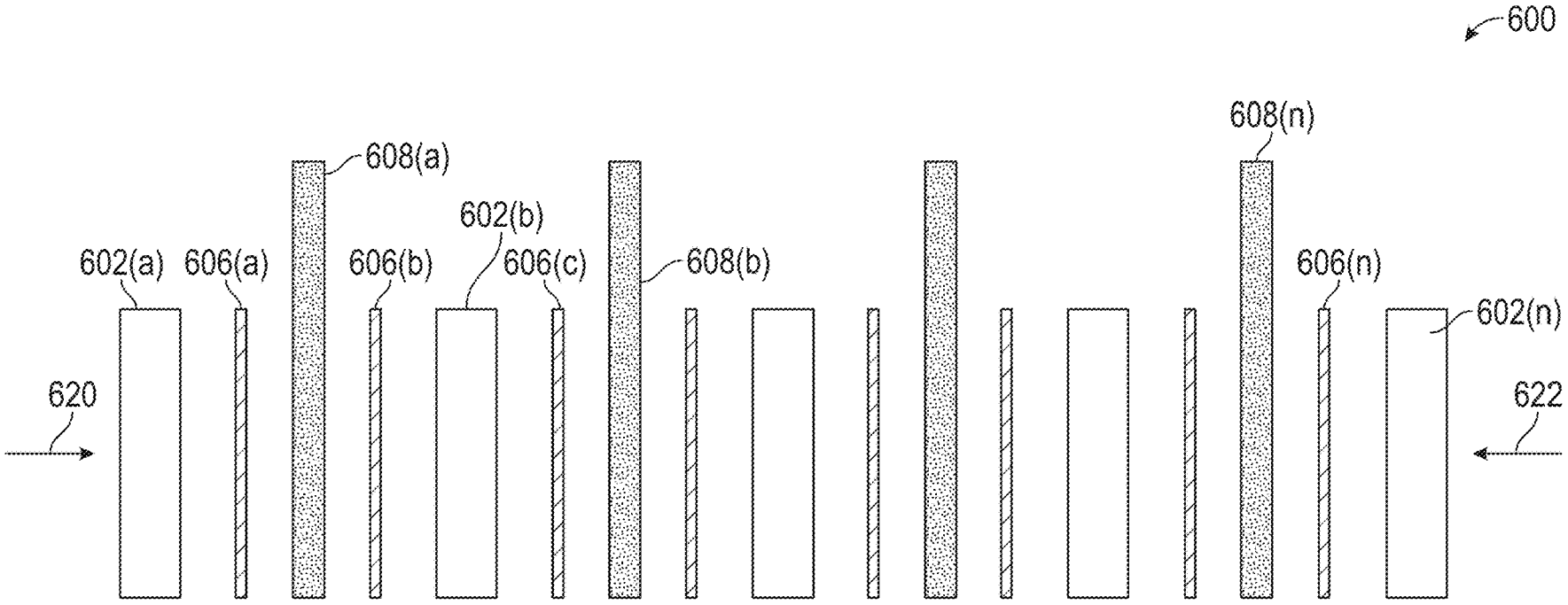
FIG. 6 shows an illustration of layered field emission cathode having metal, braze alloy and carbon fiber fabric.

FIG. 6 shows an illustration of layered field emission cathode 600 having metal, braze alloy and carbon fiber fabric. As shown in FIG. 6, the field emission cathode 600 has a plurality of substrate layers 602(*a*) . . . (n) (where "n" is any suitable number), a plurality of braze alloy layers 606(*a*) . . . (n) (where "n" is any suitable number), and a plurality of carbon fiber fabric layers 608(*a*) . . . (n) (where "n" is any suitable number). Also shown are compression forces 620 and 622. As shown in FIG. 6, various ones of the carbon fiber fabric (generally 608) may be shared between braze alloy layers (generally 606). As shown by elements 602(*a*), 606(*a*), 608(*a*), 606(*b*) and 602(*b*), the carbon fiber fabric layer 608(*a*) may be common to braze alloy 606(*a*) and 606(*b*). Thus, the layered cathode 600 can be assembled as shown in FIG. 6 with shared carbon fabric layers (generally 608).

Figure 7:
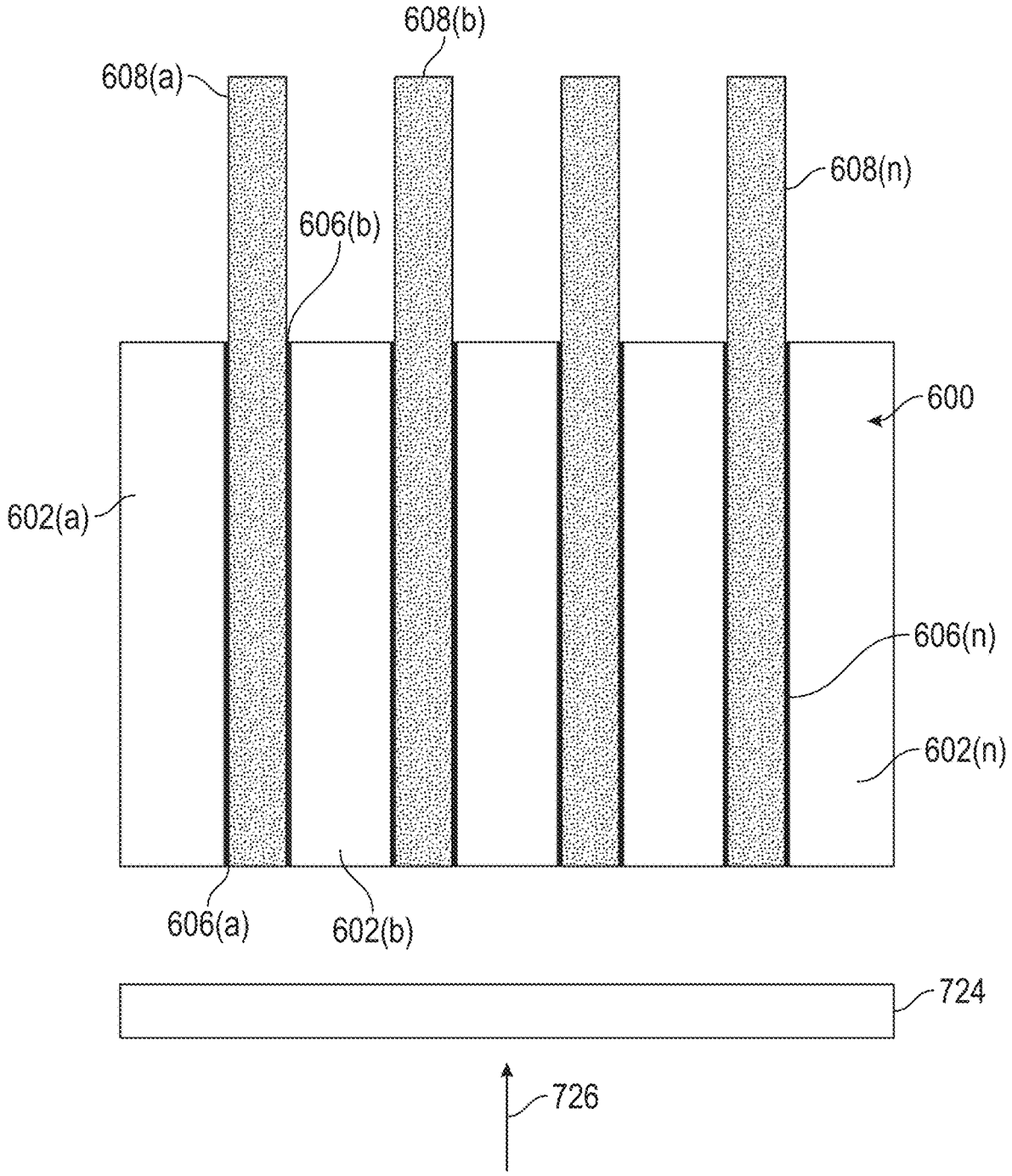
FIG. 7 shows an illustration of a layered field emission cathode to be attached to a conformal conductive plate.

FIG. 7 shows an illustration 700 of a layered field emission cathode 600 to be attached to a conformal conductive plate 724. The layered cathode 600 has a plurality of substrate layers 602(*a*) . . . (n) (where "n" is any suitable number), a plurality of braze alloy layers 606(*a*) . . . (n) (where "n" is any suitable number), and a plurality of carbon fiber fabric layers 608(*a*) . . . (n) (where "n" is any suitable number). Similar to the description of FIG. 6, various ones of the carbon fiber fabric (generally 608) may be shared between braze alloy layers (generally 606). As shown by elements 602(*a*), 606(*a*), 608(*a*), 606(*b*) and 602(*b*), the carbon fiber fabric layer 608(*a*) may be common to braze alloy 606(*a*) and 606(*b*). Similarly, the carbon fiber fabric

608(*b*) . . . (n) may be shared between associated braze alloy layer (606) and substrates (602). A conductive plate 724 is shown attached by the application of force 726.

Referring to FIG. 6 and FIG. 7, layered configurations of metal (602), braze alloy (606), and patterned carbon fiber fabric (608) may be used to form field emission cathodes, as depicted in FIG. 6. Once assembled, the base ofthe layered cathode assembly may be attached to a conductive plate or other conformal structure 724 for additional mechanical support and electrical connectivity.

The layered field emission cathode 600 may be installed into an electron beam generating device such that the carbon fabric electron emission surfaces and volume within the electron beam generating device in which the beam is intended to propagate is at vacuum.

Figure 8:
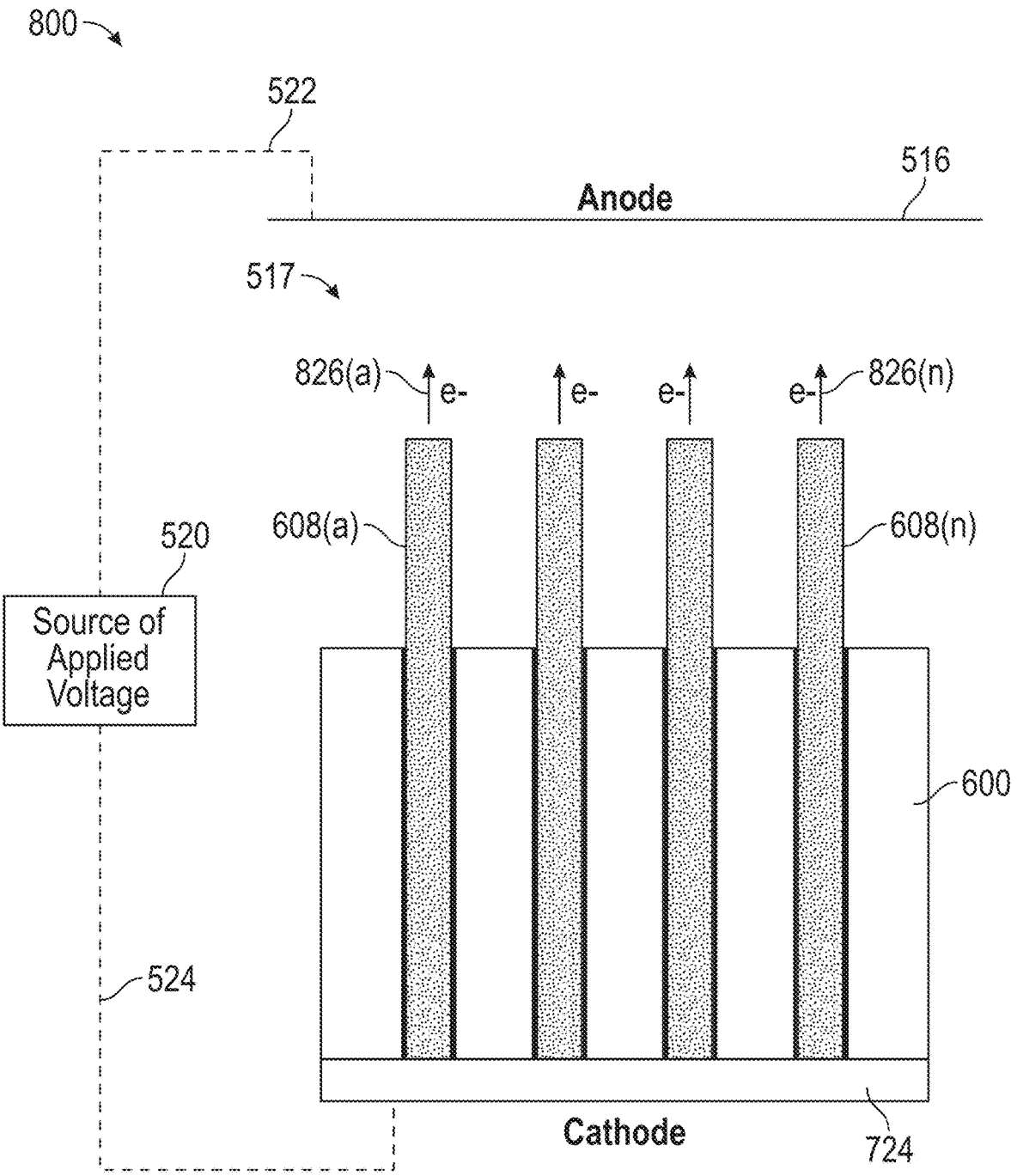
FIG. 8 shows an illustration of electron field emission from layered carbon fabric cathodes having carbon to metal bonds.

FIG. 8 shows an illustration 800 of electron field emission from layered carbon fabric cathodes having carbon to metal bonds. FIG. 8 shows cathode 600, plate 724, vacuum region 517, anode 516, source of applied voltage 520 and electron beams 826(*a*) . . . (n) (where "n" is any suitable number). The cathode 600 has plate 724 and shared patterned carbon fiber fabric layers 608(*a*) . . . (n) (where "n" is any suitable number). The patterned carbon fiber fabric layers (generally 608) extend and emit electrons (generally 826). The cathode plate 724 of emission cathode 600 is operatively coupled to source of applied voltage 520, via path 524. The source of applied voltage 520 is operatively coupled to anode 516 via path 522.

A source of applied voltage 520 is connected between the cathode structure 600 and the surfaces of electron beam generating device that serve as the anode 516. The applied voltage may be continuous, pulsed, or some arbitrary time-changing waveform. During periods of time in which electron emission 826 from the cathode is desired, the applied voltage waveform can be such that the cathode 600 is at a negative voltage with respect to the anode 516. Additionally, during periods of time in which electron emission from the cathode is desired the voltage between the cathode and the anode can be of sufficient magnitude that electrons will tunnel from the carbon fibers comprising the carbon fabric layer 608 into the gap, according to the field emission process, where they will be accelerated toward the anode 516.

A continuous, pulsed, or time-changing magnetic field may also be present in the region of the cathode and beam propagation regions of the electron beam generating device as desired for proper motion of the electron beam within the device.

Figure 9:
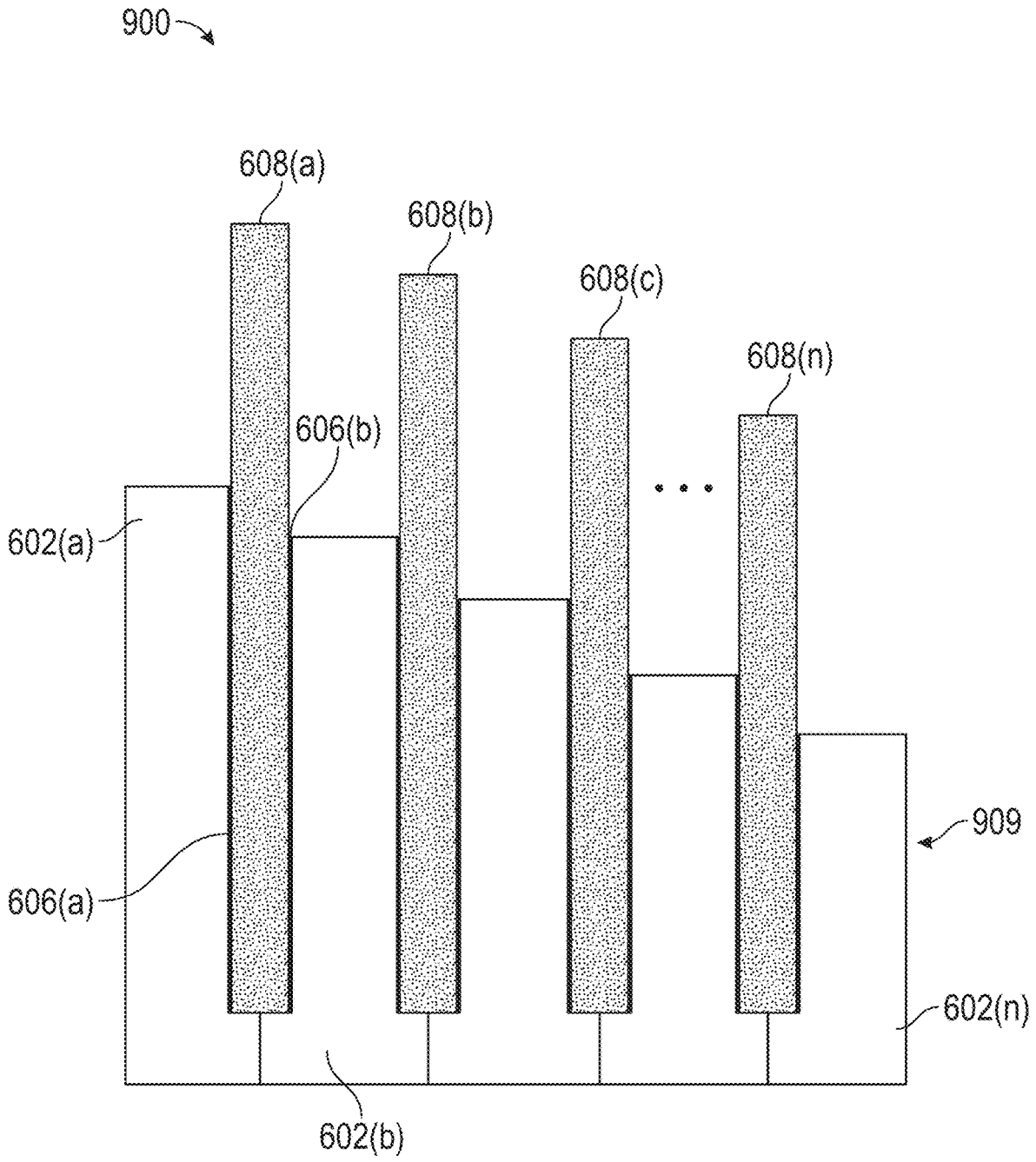
FIG. 9 shows an illustration of an echelon configuration for layered carbon fabric field emission cathode.

FIG. 9 shows an illustration 900 of an echelon configuration for layered carbon fabric field emission cathode 909. The layered carbon fabric field emission cathode 909 has a plurality of layered patterned carbon fabric layers 608(*a*) . . . (n) (where "n" is any suitable number). A plurality of metal substrate layers 602(*a*) . . . (n) (where "n" is any suitable number) and a plurality of braze alloy layers 606(*a*) . . . (n) (where "n" is any suitable number). The carbon fabric field emission layers 608(*a*) . . . (n) are in an echelon configuration, with the length of the fabric incrementally different. As shown in FIG. 9, fabric 608(*a*) extends further than fabric 608(*b*), which extends further than 608(*c*), etc.

In the layered configuration shown in FIG. 5 a substantial fraction of the electrons from the cathode will be preferentially emitted from the edges of the fabric layers as well as other surfaces, depending on the applied electric field profile. The fabric layers may be approximately flush with the surface of the metal slabs, or may impinge into the vacuum space some distance, as shown in FIG. 8. Additionally, the layers may be staggered or echeloned as shown in FIG. 9 to form another embodiment of cathode surfaces.

Fabrics comprised of carbon nanotubes or bundles of carbon nanotubes, sometimes called "carbon nanotube yarn" or "carbon nanotube fibers" may be substituted for or woven into the previously described carbon fiber fabric. Paper-like arrays of carbon fibers, carbon nanotubes (sometimes called "buckeypaper"), carbon nanotube fibers, or some combination thereof may be considered to be carbon fabrics in the context of the present disclosure and, thus, may be substituted for the potentially thicker carbon fiber fabric described elsewhere in the present disclosure.

In some cases, it may be desired that carbon fiber may be interwoven with metallic fibers or woven into a metallic screen or perforated metal surface for mechanical support. For these cases, some portion of the surface of the hybrid metal-carbon fabric material not intended for emission will be brazed to the metallic cathode substrate, leaving the intended electron emission region exposed. The chosen braze alloy bonds the carbon fiber and the metal support structures to the metallic cathode substrate, enabling formation of the field emission cathode.

Depending on the specifications of the cathode application, the carbon fiber material comprising any portion of the fabric may be coated with or may be partially or completely converted to silicon carbide (e.g., using a chemical process) to enhance wettability for the chosen braze, solder, or alloy used to join the fabric to the metal substrate.

Another embodiment of the present disclosure is directed to an electron beam generating device, such as a vacuum electrode tube having a cathode or cathodes comprised of a carbon fabric emission layer bonded to a metal substrate.

The notional configuration of an electron beam generating device having a cathode or cathodes comprised of a carbon fabric emission layer bonded to a metal substrate will be analogous to a similar device having another type of field emission cathode with the exception being that of the cathode itself.

Figure 10:
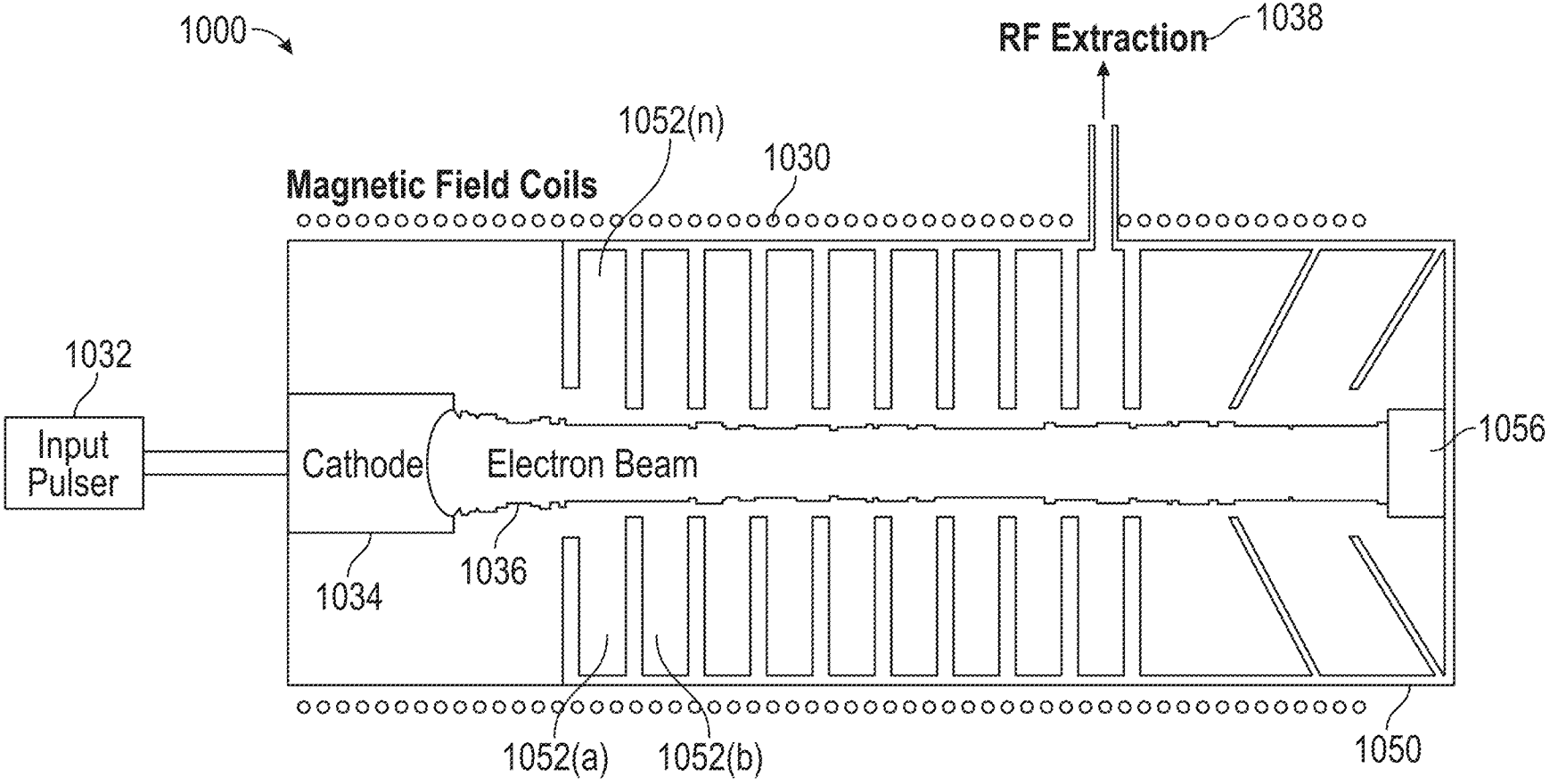
FIG. 10 shows an example of linear beam tube geometry.

FIG. 10 shows an example of linear beam tube geometry 1000. Specifically, FIG. 10 shows a representation of a linear beam high power microwave tube device 1050, being an electron beam generating device. The tube 1050 has a plurality of cavities 1052(*a*) . . . (n) (where "n" is any suitable number). Input pulser 1032 provides input to cathode 1034, which produces electron beam 1036. Magnetic coils 1030 and RF extraction port 1038 are also shown.

In the linear beam tube example depicted in FIG. 10, a negative voltage (with respect to the anode) is applied to the cathode 1034. Here, the anode is comprised of 1056 and utilizes the tube body 1050 and slow wave structure 1052 (shown as a series of coupled cavities 1052(*a*) . . . (n) (where "n" is any suitable number)). Electrons that are released from the surface of the carbon fabric will travel across the anode-cathode gap. The electron beam 1036, confined by the applied magnetic field, travels through the slow wave structure 1052. Through electromagnetic interaction with the slow wave structure, oscillatory electromagnetic waves will be produced.

The specific process or processes whereby the oscillatory electromagnetic waves are produced are available in the literature and will not be discussed in depth here. The RF energy, in the form of microwaves will then be extracted 1038 from the device 1050 for use. Various types of linear beam microwave tubes that would benefit from having a field emission cathode of the type comprised by the present disclosure include, but are not limited to klystrons, gyrotrons, and traveling wave tubes. Some tubes which may utilize field emission cathodes, such as that of the present disclosure, but do not always utilize an applied magnetic field, are vircators (which may be constructed in linear or radial electron beam emission geometries), and flash x-ray tubes.

The cathode described herein will benefit various types of crossed-field microwave tubes including magnetrons, recirculating planar magnetrons (RPMs), crossed-field amplifiers (CFAs), and recirculating planar crossed field amplifiers (RPCFAs), which often utilize an externally applied magnetic field. Some tubes which may utilize field emission cathodes, such the present disclosure, but do not always require an externally applied magnetic field, are magnetically insulated line oscillators (MILO).

Figure 11:
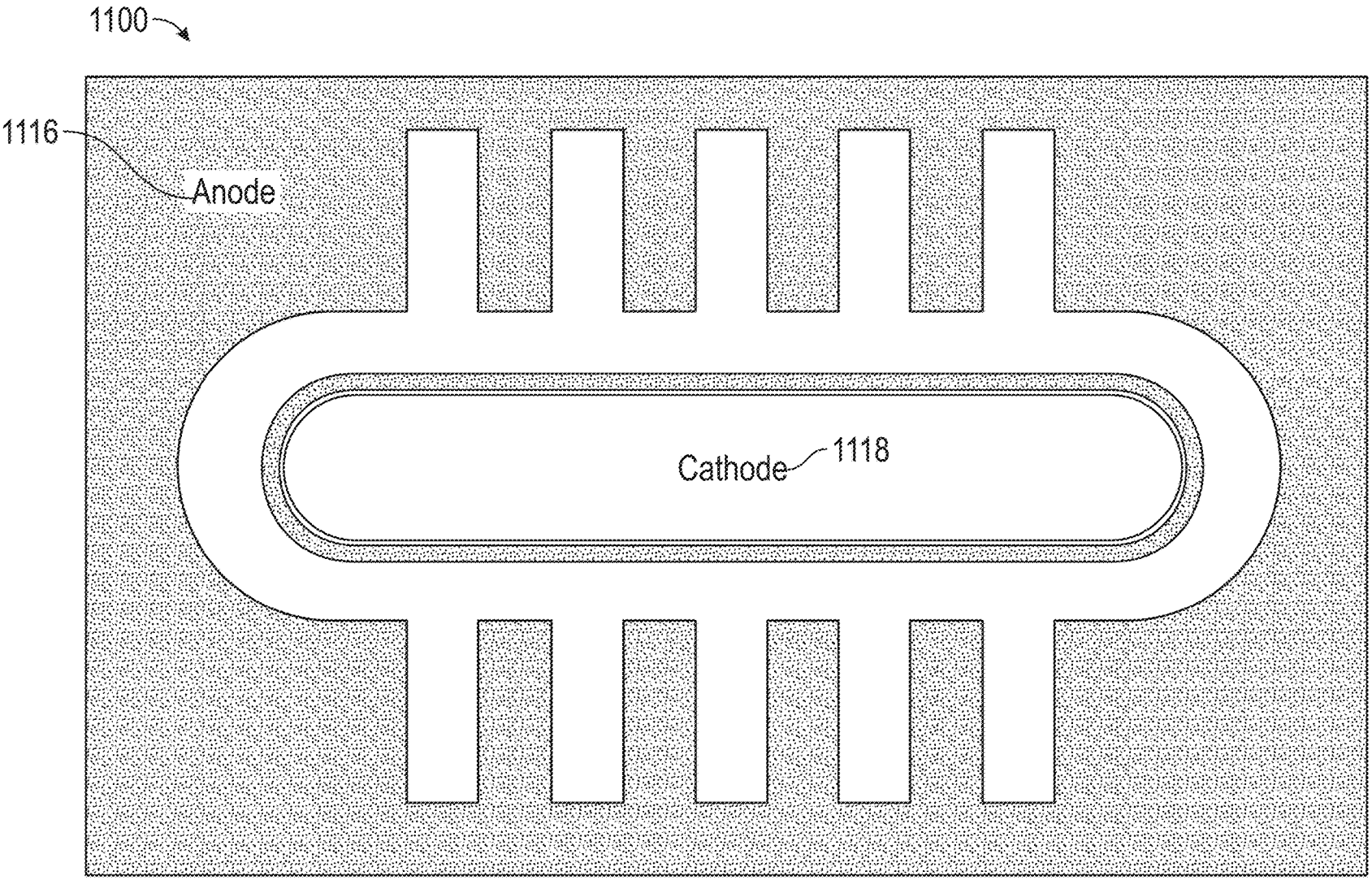
FIG. 11 shows an example of crossed field electron beam tube geometry.

FIG. 11 shows an illustration 1100 of crossed field electron beam tube geometry. FIG. 11 shows anode 1116 and cathode 1118.

In the crossed-field microwave tube example depicted in FIG. 11, a negative voltage (with respect to the anode 1116) is applied to the cathode 1118 and a magnetic field is applied generally in a direction perpendicular to the electric field resulting from the applied voltage across the anode-cathode gap. The specific example shown here depicts a representation of a recirculating planar magnetron. The anode 1116 is comprised of the tube body and slow wave structure (shown as a series of cavities on the upper and lower portions of the anode). Electrons that are released from the surface of the carbon fabric will behave as generally described with respect to recirculating planar magnetrons for high-power high-frequency radiation generation. Through electromagnetic interaction with the slow wave structure, oscillatory electromagnetic waves will be produced.

The specific process or processes whereby the oscillatory electromagnetic waves are produced are available in the literature and will not be discussed in depth here. The RF energy, in the form of microwaves will then be extracted from the device for use.

Figure 12:
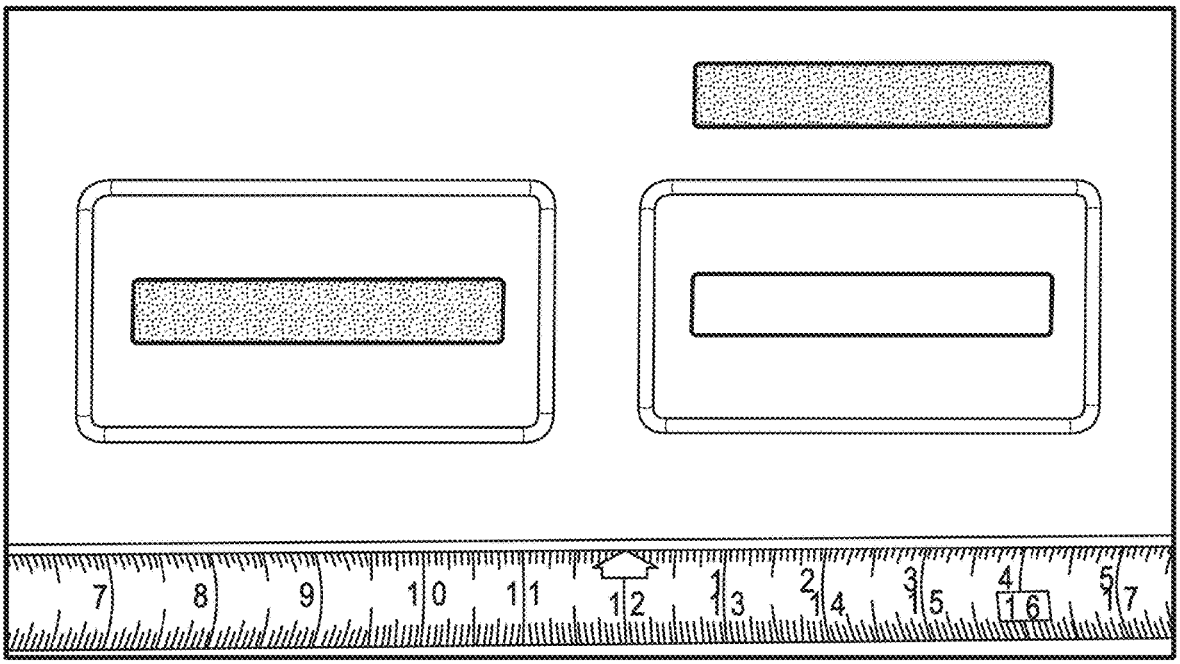
FIG. 12 shows an example of a carbon fabric field emission cathode.

FIG. 12 shows a carbon fabric field emission cathode, intended to be part of a recirculating planar magnetron amplifier, prior to application of the brazing alloy. As shown in FIG. 12, the carbon fabric field emission cathode is positioned adjacent to a measuring ruler, which shows the approximate dimensions, in inches and centimeters. One of skill in the art will appreciate that while certain dimensions are shown in FIG. 12, as indicated by the measuring tape, alternate dimensions and/or sizes may be used without departing from the spirit and scope of the claimed invention. Indeed, either smaller or larger materials maybe used depending on the desired implementation or instantiation of the concepts disclosed herein.

Figure 13:
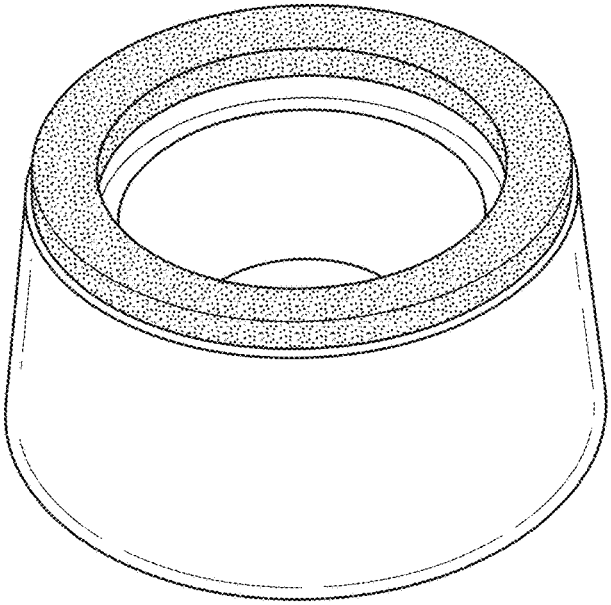
FIG. 13 shows an example of an annular beam field emission cathode.
Figure 14:
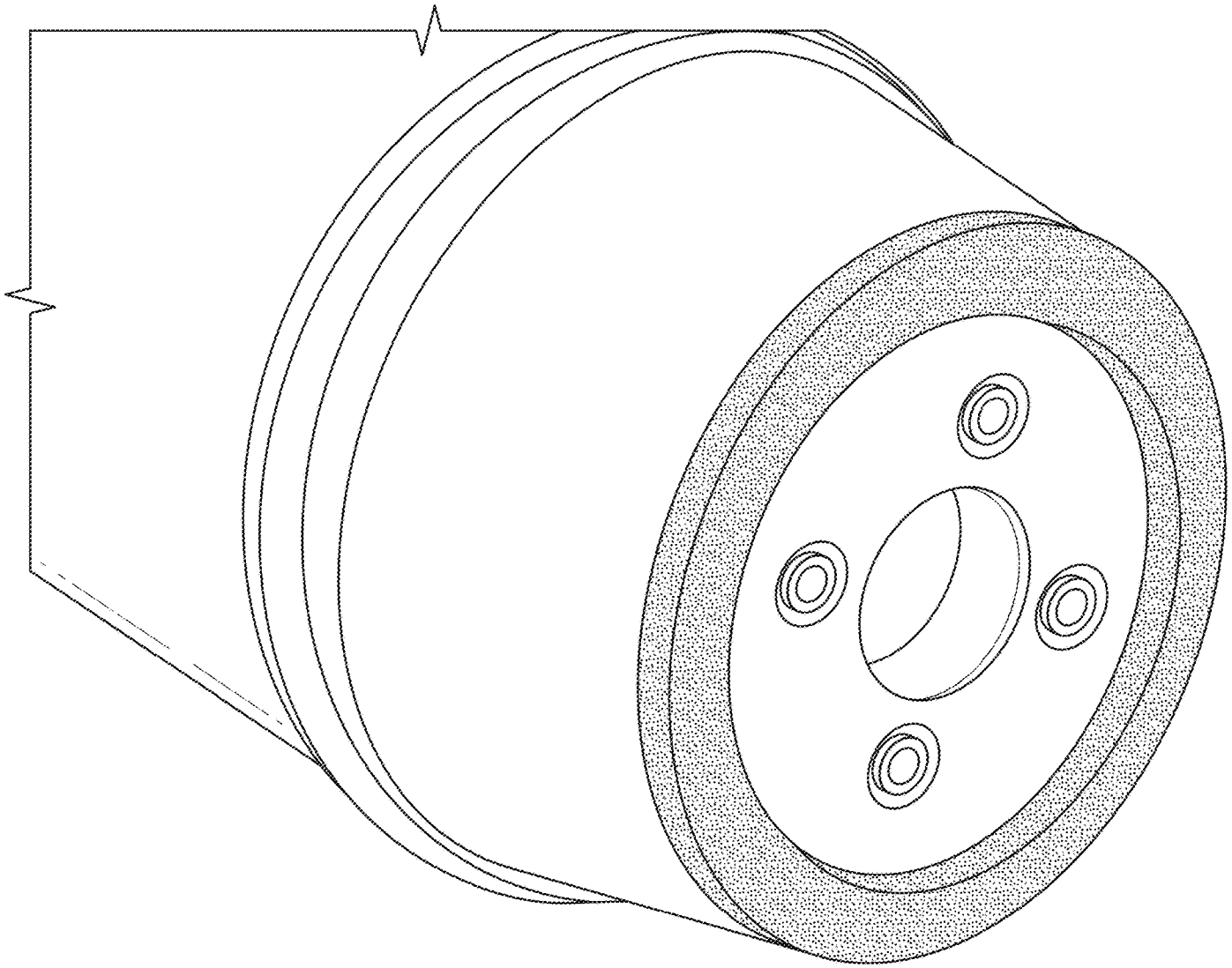
FIG. 14 shows an example of an annular beam field emission cathode.

FIG. 13 provides a photo of an annular beam carbon fabric field emission cathode after brazing. FIG. 14 shows the cathode from FIG. 13 after being installed into the electron gun portion of a linear beam tube.

Figure 15:
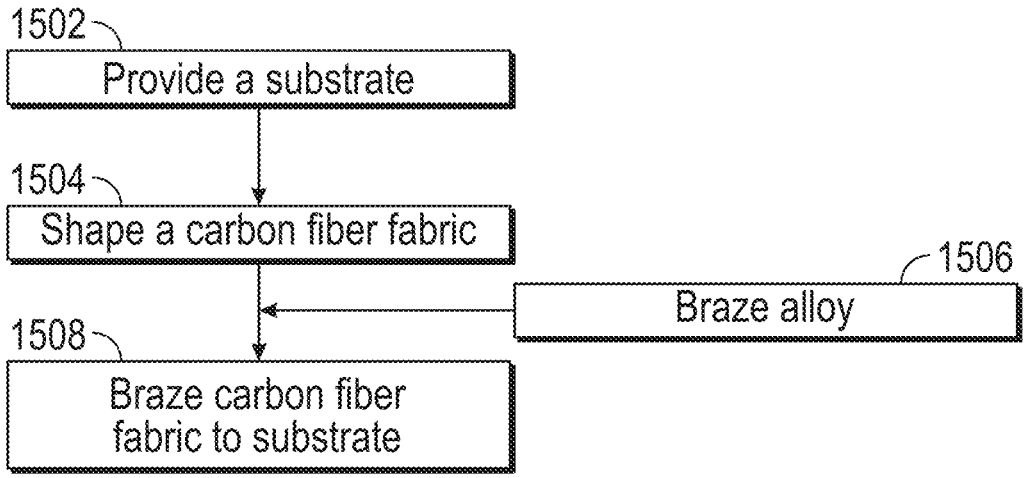
FIG. 15 shows a process of brazing a carbon fiber fabric to a substrate.

FIG. 15 shows a process to braze a carbon fiber fabric to a substrate. As shown, a substrate is provided (1502). This substrate may be metal. The carbon fiber fabric is shaped (1504). This shaping may include cutting, or other manipulation to form the fabric into a desired pattern. A braze alloy may be introduced (1506). The patterned carbon fiber fabric is brazed to the substrate (1508).

Various embodiments of the present disclosure are described herein and include examples of the present disclosure. The embodiments described above and summarized below are combinable.

One embodiment is directed to a method for constructing a field emission device, comprising: providing a metal cathode substrate; shaping a carbon fiber fabric into a pattern, creating a patterned carbon fiber fabric; and brazing at least a portion of the patterned carbon fiber fabric to the metal cathode substrate.

Another embodiment is directed to the method for constructing a field emission device further comprising providing a vacuum region that surrounds at least a portion of the carbon fiber fabric that emits electrons.

Another embodiment is directed to the method for constructing a field emission device further comprising providing an anode in proximity to the portion of the carbon fabric that emits electrons, the vacuum region separating the anode and the cathode.

Another embodiment is directed to the method for constructing a field emission device further comprising applying a voltage between the anode and the cathode that establishes an electric field that enables emission of electrons from the carbon fiber fabric to the vacuum region.

Another embodiment is directed to the method for constructing a field emission device, where the metal cathode substrate further includes copper or stainless steel.

Another embodiment is directed to the method for constructing a field emission device, where the carbon fiber fabric further includes carbon fibers woven into a cloth.

Another embodiment is directed to the method for constructing a field emission device, where the carbon fiber fabric further includes carbon fibers interwoven with metallic fibers.

Another embodiment is directed to the method for constructing a field emission device, where the carbon fiber fabric further includes carbon fibers pressed into a felt.

Another embodiment is directed to the method for constructing a field emission device, where shaping the carbon fiber fabric further comprising treating the carbon fiber fabric to enhance its field emission properties.

Another embodiment is directed to the method for constructing a field emission device, where shaping the carbon fiber fabric further includes cutting the carbon fiber fabric.

Another embodiment is directed to the method for constructing a field emission device, where cutting the carbon fiber fabric further includes cutting the carbon fiber fabric with a laser.

Another embodiment is directed to the method for constructing a field emission device, where brazing the patterned carbon fiber fabric to the metal cathode substrate further includes placing a brazing alloy between the patterned carbon fiber fabric and the metal cathode substrate.

Another embodiment is directed to the method for constructing a field emission device, where brazing the patterned carbon fiber fabric to the metal cathode substrate further includes: compressing the patterned carbon fiber fabric onto the metal cathode substrate; and heating the patterned carbon fiber fabric, the brazing alloy, and the metal cathode substrate.

Another embodiment is directed to a field emission device, comprising: a metal cathode substrate; and a patterned carbon fiber fabric; where at least a portion of the patterned carbon fiber fabric is brazed to the metal cathode substrate.

Yet another embodiment is directed to the field emission device further comprising: a vacuum region that surrounds at least a portion of the carbon fiber fabric that is configured to emit electrons.

Yet another embodiment is directed to the field emission device further comprising: an anode in proximity to the portion of the carbon fabric configured to emit electrons, the vacuum region separating the anode and the cathode.

Yet another embodiment is directed to the field emission device further comprising: a voltage source between the anode and the cathode configured to establish an electric field that enables emission of electrons from the carbon fiber fabric to the vacuum region.

Yet another embodiment is directed to the field emission device, where the metal cathode substrate further includes copper or stainless steel.

Yet another embodiment is directed to the field emission device, where the patterned carbon fiber fabric further includes carbon fibers woven into a cloth.

Yet another embodiment is directed to the field emission device, where the patterned carbon fiber fabric further includes carbon fibers interwoven with metallic fibers.

Yet another embodiment is directed to the field emission device, where the patterned carbon fiber fabric further includes carbon fibers pressed into a felt.

Yet another embodiment is directed to the field emission device, where the patterned carbon fiber fabric further includes a negative electron affinity substance to enhance electron emission.

Yet another embodiment is directed to an electron beam generating device comprising a cathode described above.

Yet another embodiment is directed to the electron beam generating device, where the electron beam generating device further includes a linear beam microwave tube.

Yet another embodiment is directed to the electron beam generating device, where the linear beam microwave tube further includes one of a klystron, gyrotron, and traveling wave tube.

Yet another embodiment is directed to the electron beam generating, where the electron beam generating device further includes a crossed-field microwave tube.

Yet another embodiment is directed to the electron beam generating device, where the crossed-field microwave tube further includes one of a cavity magnetron, recirculating planar magnetron, crossed-field amplifier, and recirculating planar crossed field amplifier.

Yet another embodiment is directed to the electron beam generating device, where the electron beam generating device further includes a visual display.

Yet another embodiment is directed to the electron beam generating device, where the electron beam generating device further includes a particle accelerator.

Yet another embodiment is directed to a cathode device, having a structure formed by a metal layer, a braze layer and a fabric layer.

Yet another embodiment is directed to the cathode, where the structure is formed by staggered layers.

Yet another embodiment is directed to the cathode, where a substantial fraction of emitted electrons is emitted from an edge of the fabric.

Yet another embodiment is directed to the cathode, where the fabric is approximately flush with an adjacent surface of the substrate.

Yet another embodiment is directed to the cathode, where the fabric extends beyond an adjacent surface of the substrate and impinges into a vacuum space.

Yet another embodiment is directed to the cathode, where the fabric includes carbon nanotubes.

Yet another embodiment is directed to a field emission device comprising: a metal cathode substrate; a carbon fiber fabric formed into a pattern configured to cover at least a portion of the metal cathode substrate; and a braze alloy or metallic compound, having a predetermined form prior to brazing, configured to form a carbon to metal bond.

Yet another embodiment is directed to the field emission device further comprising: a vacuum region that surrounds at least a portion of the carbon fiber fabric that is configured to emit electrons.

Yet another embodiment is directed to the field emission device further comprising: an anode in proximity to the portion of the carbon fabric configured to emit electrons, the vacuum region separating the anode and the cathode.

Yet another embodiment is directed to the field emission device further comprising: a voltage source between the anode and the cathode configured to establish an electric field that enables emission of electrons from the carbon fiber fabric to the vacuum region.

Yet another embodiment is directed to the field emission device further comprising: a polyphase layer structure adhering the metallic compound substrate to the carbon fiber fabric.

Yet another embodiment is directed to the field emission device, where the polyphase structure is based in part on a chemical reaction between the surface of individual carbon fibers being wet by the braze alloy or metallic compound.

Yet another embodiment is directed to a system comprising: an anode; a cathode having a metal cathode substrate and a patterned carbon fiber fabric, at least a portion of the patterned carbon fiber fabric is brazed to the metal cathode substrate and in operation an applied voltage is configured to propagate electrons from the carbon fiber toward the anode.

Yet another embodiment is directed to the system further comprising: a vacuum region that surrounds at least a portion of the carbon fiber fabric that is configured to emit electrons.

Yet another embodiment is directed to the system further comprising: an electronic beam generating device, where a continuous magnetic field is proximate to a region of the cathode and a beam propagation region of the electron beam generating device.

Yet another embodiment is directed to the system, where the anode is an electron beam generating device.

Although the following detailed description contains many specifics for the purposes of illustration, anyone of ordinary skill in the art will appreciate that many variations and alterations to the following details are within the scope of the disclosure. Accordingly, the following embodiments are set forth without any loss of generality to, and without imposing limitations upon, the claims.

In this detailed description, a person skilled in the art should note that directional terms, such as "above," "below," "upper," "lower," and other like terms are used for the convenience of the reader in reference to the drawings. Also, a person skilled in the art should notice this description may contain other terminology to convey position, orientation, and direction without departing from the principles of the present disclosure.

Furthermore, in this detailed description, a person skilled in the art should note that quantitative qualifying terms such as "generally," "substantially," "mostly," "approximately" and other terms are used, in general, to mean that the referred to object, characteristic, or quality constitutes a majority of the subject of the reference. The meaning of any of these terms is dependent upon the context within which it is used, and the meaning may be expressly modified.

Some of the illustrative embodiments of the present disclosure may be advantageous in solving the problems herein described and other problems not discussed which are discoverable by a skilled artisan. While the above description contains much specificity, these should not be construed as limitations on the scope of any embodiment, but as exemplifications of the presented embodiments thereof. Many other ramifications and variations are possible within the teachings of the various embodiments. While the disclosure has been described with reference to exemplary embodiments, it will be understood by those skilled in the art that various changes may be made and equivalents may be substituted for elements thereof without departing from the scope. In addition, many modifications may be made to adapt a particular situation or material to the teachings without departing from the essential scope thereof.

Therefore, it is intended that the disclosure not be limited to the particular embodiment disclosed as the best or only mode contemplated for carrying out this invention, but that the disclosure will include all embodiments falling within the scope of the appended claims. Also, in the drawings and the description, there have been disclosed exemplary embodiments and, although specific terms may have been employed, they are unless otherwise stated used in a generic and descriptive sense only and not for purposes of limitation, the scope of the disclosure therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item. Thus, the scope of the disclosure should be determined by the appended claims and their legal equivalents, and not by the examples given.

The invention claimed is:

1. A method for constructing a field emission device, comprising:

providing a metal cathode substrate;

shaping a carbon fiber fabric into a pattern, creating a patterned carbon fiber fabric; and brazing at least a first portion of the patterned carbon fiber fabric to the metal cathode substrate.

2. The method of claim 1, further comprising: providing a vacuum region that surrounds at least a second portion of the carbon fiber fabric that emits electrons.

3. The method of claim 2, further comprising: providing an anode in proximity to the second portion of the carbon fabric that emits electrons, the vacuum region separating the anode and the cathode.

4. The method of claim 3, further comprising: applying a voltage between the anode and the cathode that establishes an electric field that enables emission of electrons from the carbon fiber fabric to the vacuum region.

5. The method of claim 1, where the metal cathode substrate further includes copper or stainless steel.

6. The method of claim 1, where the carbon fiber fabric further includes carbon fibers woven into a cloth.

7. The method of claim 6, where the carbon fiber fabric further includes carbon fibers interwoven with metallic fibers.

8. The method of claim 1, where the carbon fiber fabric further includes carbon fibers pressed into a felt.

9. The method of claim 1, further comprising treating the carbon fiber fabric to enhance its field emission properties.

10. The method of claim 1, where shaping the carbon fiber fabric further includes cutting the carbon fiber fabric.

11. The method of claim 1, where brazing the patterned carbon fiber fabric to the metal cathode substrate further includes placing a brazing alloy between the patterned carbon fiber fabric and the metal cathode substrate.

12. The method of claim 11, where brazing the patterned carbon fiber fabric to the metal cathode substrate further includes:

compressing the patterned carbon fiber fabric onto the metal cathode substrate; and heating the patterned carbon fiber fabric, the brazing alloy, and the metal cathode substrate.

* * * * *